US011084144B2

(12) United States Patent
Bates

(10) Patent No.: US 11,084,144 B2
(45) Date of Patent: Aug. 10, 2021

(54) SANDING BLOCK

(71) Applicant: Scott Bates, Whitney Point, NY (US)

(72) Inventor: Scott Bates, Whitney Point, NY (US)

( * ) Notice: Subject to any disclaimer, the term of this patent is extended or adjusted under 35 U.S.C. 154(b) by 299 days.

(21) Appl. No.: 16/382,393

(22) Filed: Apr. 12, 2019

(65) Prior Publication Data

US 2019/0314956 A1 Oct. 17, 2019

Related U.S. Application Data

(60) Provisional application No. 62/656,473, filed on Apr. 12, 2018.

(51) Int. Cl.
*B24D 15/02* (2006.01)

(52) U.S. Cl.
CPC ..... *B24D 15/02* (2013.01)

(58) Field of Classification Search
CPC ..... B24D 15/02; B24D 15/023; B24D 13/147
USPC ..... 451/522, 523, 503, 513, 504, 507, 512; 205/104; 248/188.2; 403/374.1, 374.4
See application file for complete search history.

(56) References Cited

U.S. PATENT DOCUMENTS 2,248,884 A 7/1941 Mcadams
3,063,208 A * 11/1962 Bell ..... B24D 15/023 451/504
3,601,933 A * 8/1971 Bowen ..... B24D 15/023 451/504
4,813,189 A * 3/1989 Bolduc ..... B24D 15/023 451/513
5,387,251 A 2/1995 Rouse
7,780,506 B2 8/2010 Wettstein et al.
8,870,629 B2 10/2014 Comstock et al.
2008/0172896 A1 7/2008 Frantellizzi

OTHER PUBLICATIONS

STIC NPL and Patent Search Results (Year: 2021).*

* cited by examiner

*Primary Examiner* — Monica S Carter
*Assistant Examiner* — Alberto Saenz
(74) *Attorney, Agent, or Firm* — Boudwin Intellectual Property; Daniel Boudwin

(57) ABSTRACT

A sanding block. The sanding block includes a first member and a second member forming a planar body. The first member and second member have opposing angled edges and are connected via a tongue and groove joint along the opposing angled edges. A continuous channel is disposed through the first and second members. A barrel nut is disposed and can revolve in the channel of the first member. A screw is rotatably disposed through an exterior edge of the second member, wherein a shaft of the screw passes through the channel and is threaded through the barrel nut. A user can rotate the screw which causes the planar body to expand and contract. As the planar body expands and contracts, the barrel nut revolves allowing the shaft of the screw to pivot. A belt of sand paper can be secured to the sanding block via expansion of the planar body.

13 Claims, 3 Drawing Sheets

SANDING BLOCK

CROSS REFERENCE TO RELATED APPLICATIONS

This application claims the benefit of U.S. Provisional Application No. 62/656,473 filed on Apr. 12, 2018. The above identified patent application is herein incorporated by reference in its entirety to provide continuity of disclosure.

BACKGROUND OF THE INVENTION

The present invention relates to sanding devices. More particularly, the present invention provides for at least an expandable sanding block that can be utilized to secure a belt of sanding paper.

Many people enjoy creating projects out of wood and performing various woodworking tasks. Cutting and shaping the wood pieces of the project can result in rough edges. One of the final stages of a woodworking project typically entails sanding the edges and surfaces of the wood to produce a smooth surface. Although small and narrow pieces of sand paper are typically used to smooth small areas of the project, some surfaces can be quite large. Woodworkers sometimes secure such small pieces of sandpaper to blocks of wood, known as sanding blocks, that enable the woodworker to manually sand a piece of wood to the desired smoothness.

Devices have been disclosed in the known art that relate to sanding blocks. These include devices that have been patented and disclosed in patent application publications. However, the devices in the known art have several drawbacks. For example, large surfaces of wood sometimes require that the woodworker turn to utilization of long sanding belts which are designed for use with electrically powered belt sanders. Such belts are long and tubular and designed to encircle a section of the power belt sander. Utilization of such power belt sanders does not offer the same fine control of the sanding process, and therefore does not allow the wood worker to sand the piece of wood while maintaining the fine details of the project. Accordingly, many woodworkers prefer to sand their projects by hand, but also desire the larger surface area that sanding belts afford.

The present invention substantially diverges in design elements from the known art and consequently it is clear that there is a need in the art for an improvement to existing sanding blocks. In this regard the present invention substantially fulfills these needs. As sanding belts are often too unwieldy to use comfortably, and traditional sanding blocks do not provide a large surface area for sanding, a sanding block that allows a user to removably secure a sanding belt thereto, thereby allowing the woodworker to utilize a sanding belt by hand is desired.

SUMMARY OF THE INVENTION

In view of the foregoing disadvantages inherent in the known types of sanding blocks now present in the prior art, the present invention provides a sanding block wherein the same can be utilized for providing convenience for the user by securing a sanding belt to a sanding block thereby enabling a woodworker to sand a piece of wood by hand with said sanding belt. The present sanding block comprises a planar body that can be expanded or contracted via operation of a screw, thereby enabling a woodworker to secure a sanding belt thereto.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
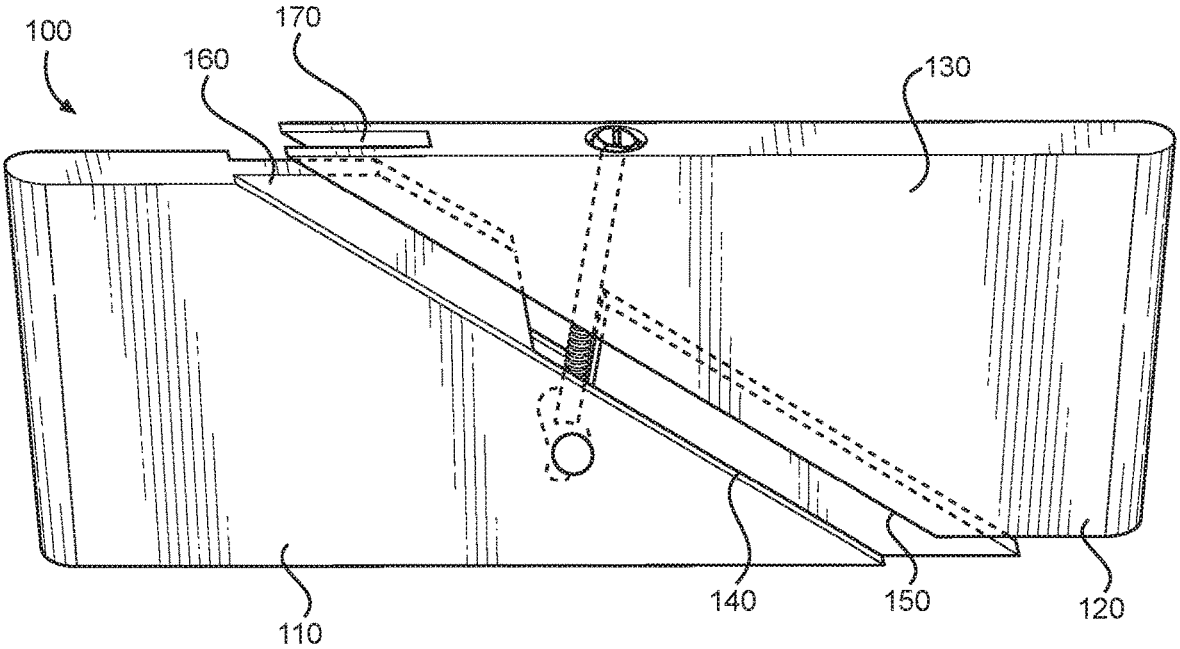
FIG. 1 shows a perspective view of an embodiment of the sanding block.

Reference is made herein to the attached drawings. Like reference numerals are used throughout the drawings to depict like or similar elements of the sanding block. For the purposes of presenting a brief and clear description of the present invention, a preferred embodiment will be discussed as used for the sanding block. The figures are intended for representative purposes only and should not be considered to be limiting in any respect.

Referring now to FIG. 1, there is shown a perspective view of an embodiment of the sanding block. The sanding block 100 comprises a first member 110 and a second member 120 forming a planar body 130. In the shown embodiment, the planar body 130 has a substantially rectangular cross section. It is contemplated by this disclosure that the planar body 130 can be of a variety of shapes and sizes to best suit the needs and hands of a user. The first member 110 has an angled edge 140 and the second member 120 has an opposing angled edge 150. In the shown embodiment, an exterior end of the first member 110, opposite the angled edge 140, is rounded on both the top and bottom surfaces. Likewise, in the shown embodiment, an exterior end of the second member 120, opposite the opposing angled edge 150, is also rounded on both the top and bottom surfaces. In such a manner, the planar body 130 can be configured to continuously receive the contours of a belt of sand paper. In other embodiments, corners or other protrusions may be utilized on the planar body 130 to more securely hold the belt of sand paper in place by friction.

In the shown embodiment the angled edge 140 of the first member 110 is thirty degrees and the opposing angled edge 150 of the second member 120 is one hundred fifty degrees. It is contemplated by this disclosure that a variety of angles may be utilized, and where the planar body is substantially rectangular in cross-section, the angled edge 140 and the opposing angled edge 150 will sum to one hundred eighty degrees.

The first member 110 and the second member 120 are connected via a mating of the angled edge 140 to the opposing angled edge 150. In the shown embodiment, this mating is enhanced in strength by a tongue and groove joint. In the shown embodiment, the first member 110 and the second member 120 and are connected via a tongue 160 disposed along the angled edge 140 of the first member 110 and a groove 170 disposed along the opposing angled edge 150 of the second member 120. The groove 170 is sized and configured to slidably receive the tongue 160. It should be understood by one of ordinary skill in the art that the depth of the tongue 160 and groove 170 is sized such that where the planar body 130 is expanded, the tongue 160 is still received by the groove 170. In such a manner, the first member 110 and the second member 120 are mated both in a fully contracted position as well as in an expanded position, and all positions in between.

Figure 2:
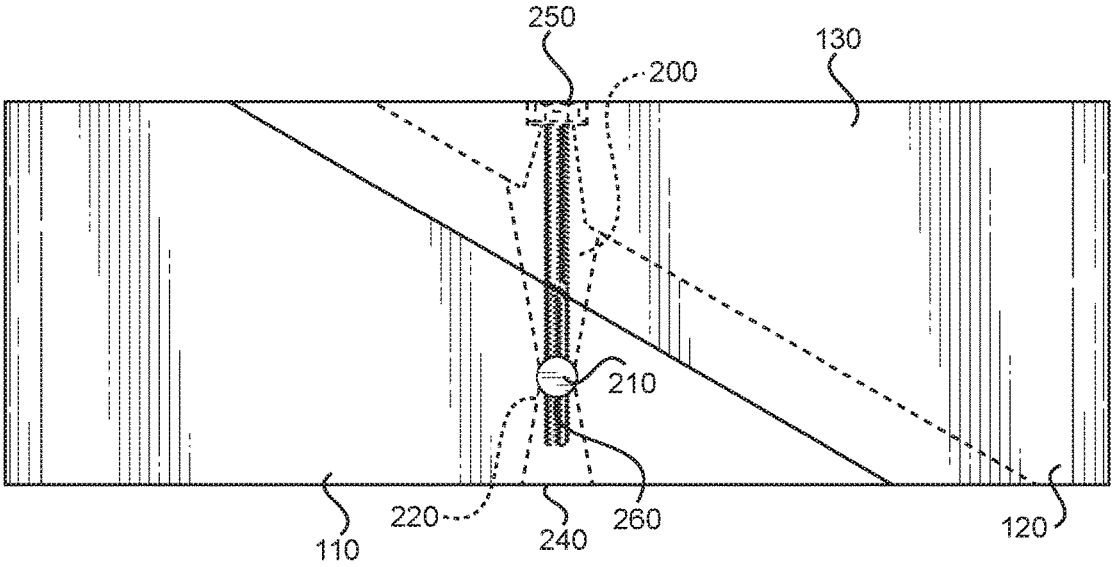
FIG. 2 shows a frontal view of an embodiment of the sanding block.
Figure 3:
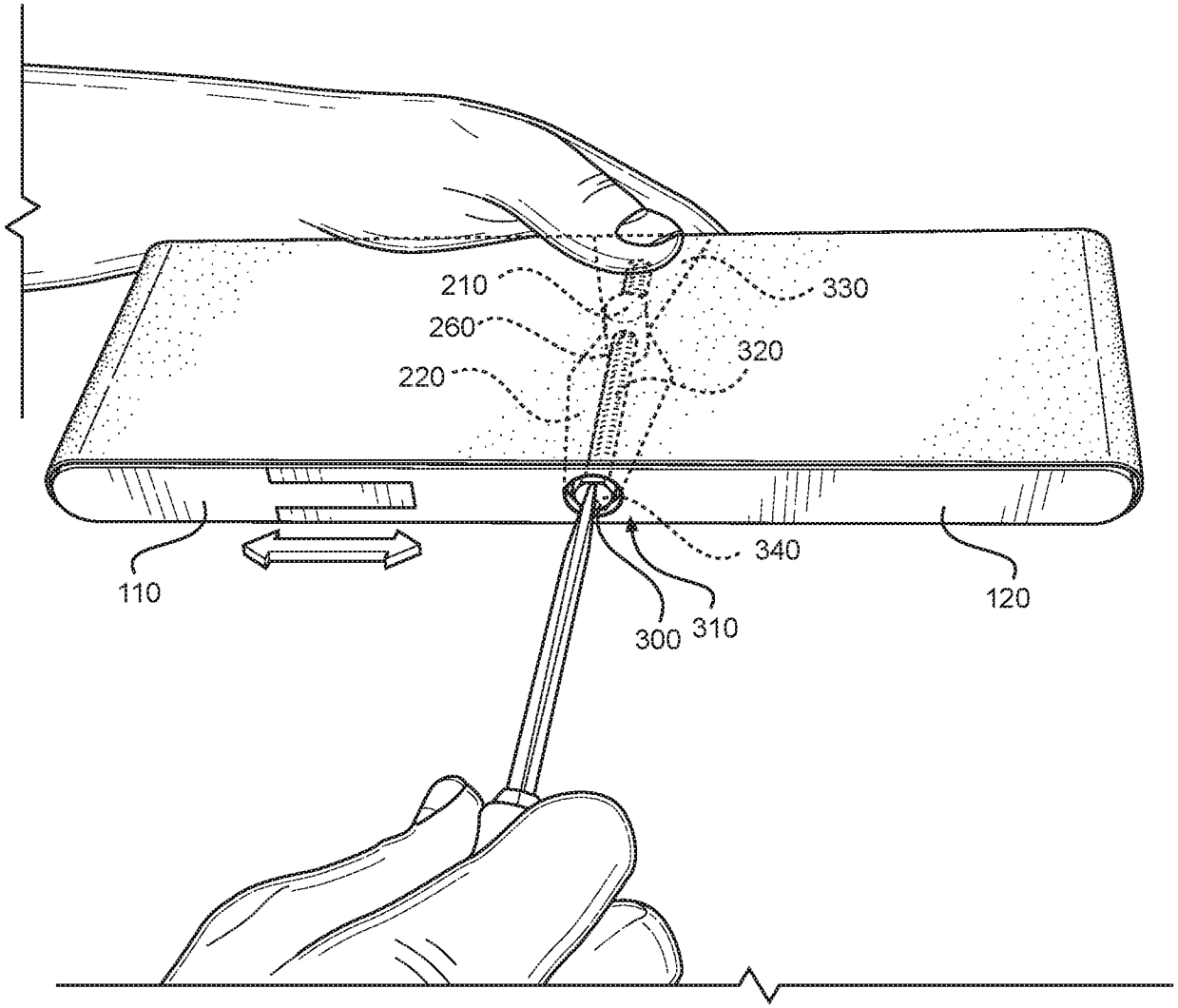
FIG. 3 shows a perspective view of an embodiment of the sanding block, with a focus on operation of the screw.

Referring now to FIG. 2, there is shown a frontal view of an embodiment of the sanding block. A continuous channel 200 is disposed through the first member 110 and the second member 120. In the shown embodiment, the channel 200 is oriented along a width of the planar body 130. In various embodiments, the width of the channel 200 can be larger than the diameter of a shaft of a screw (as shown in FIG. 3, 300) that is passed through the channel. In the shown embodiment, the width of the channel 200 tapers to allow the shaft of the screw to pivot. In the shown embodiment, the width of the channel tapers from an outer edge 240 of the first member 110 to a barrel nut 210 disposed therein, wherein the width of the channel 200 at the outer edge 240 is greater than the width of the channel 200 at the barrel nut 210. Further, in the shown embodiment, the width of the channel 200 tapers from the barrel nut 210 to the angled edge of the first member 110, wherein the width of the channel 200 at the angled edge is greater than the width of the channel 200 at the barrel nut 210. Additionally, in the shown embodiment, the width of the channel 200 tapers from an outer edge 250 of the second member 120 to the opposing angled edge of the second member 120, wherein the width of the channel 200 at the outer edge 250 is less than the width of the channel 200 at the opposing angled edge. In such a manner, the channel 200 can comprise various widths at various points in the first member 110 and the second member 120, thereby enabling a shaft of the screw that has been passed through the channel 200 to pivot while remaining in the channel 200 in both the first member 110 and the second member 120.

A barrel nut 210 is disposed in the channel portion 220 of the first member 110 and can revolve while maintaining its position in the channel portion 220 of the first member 110. The barrel nut 210 is configured to revolve along an axis defined by a plurality of receiving apertures disposed in the barrel nut 210, wherein the plurality of receiving apertures are configured to receive a shaft of a screw therethrough. The barrel nut 210 can incorporate a threaded receiving aperture 260 in order to receive the threaded portion of a shaft (as shown in FIG. 3, 320) of the screw. Where the shaft of the screw is threaded in the threaded receiving aperture 260, the barrel nut 210 can revolve in place to allow the shaft of the screw to pivot in the channel 200 as the planar body 130 is expanded or contracted.

Referring now to FIG. 3, there is shown a perspective view of an embodiment of the sanding block, with a focus on operation of the screw. The screw 300 is rotatably disposed through an exterior edge 310 of the second member, wherein the shaft 320 of the screw 300 passes through the channel portion 330 of the second member and the shaft 320 of the screw 300 is threaded through the receiving aperture 260 of the barrel nut 210 disposed in the channel portion 220 of the first member. A head 330 of the screw 300 can comprise a receiving slot 340 configured to receive an adjusting tool such as a screwdriver or a hexagonal wrench. By selectively rotating the screw 300, the threaded shaft 320 of the screw 300 can engage with the complementary threads of the receiving aperture 260 of the barrel nut 210, and thereby apply pressure causing the first member 110 to slide away from, or towards, the second member 120, thereby causing expansion or contraction of the planar body.

Figure 4:
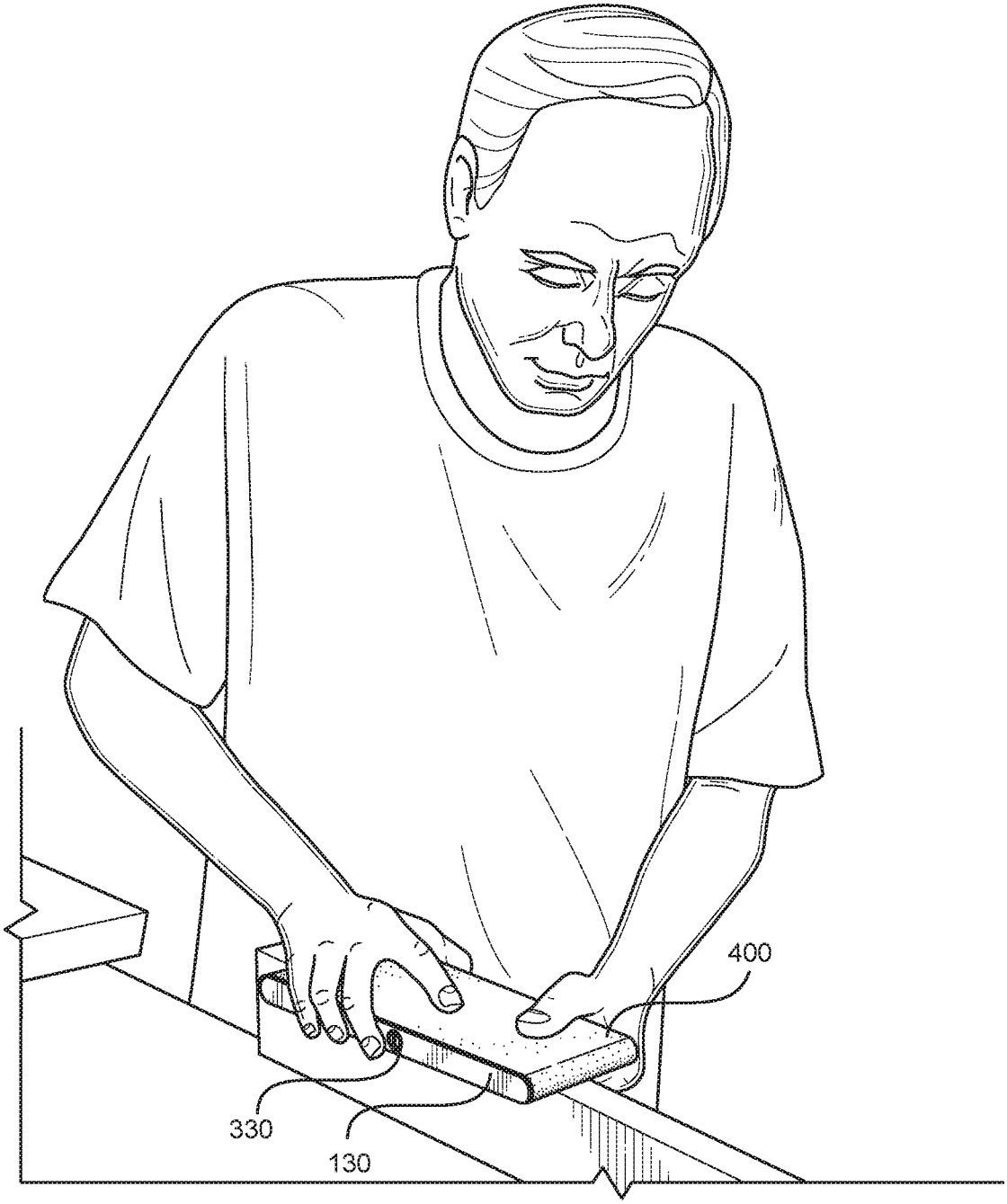
FIG. 4 shows a perspective view of an embodiment of the sanding block in use.

Referring now to FIG. 4, there is shown a perspective view of an embodiment of the sanding block in use. A user can begin with the sanding block in a contracted position such that the length of the planar body is less than the internal diameter of the sanding belt. The user can slide the sanding belt over the planar body. A user can then rotate the head 330 of the screw which causes the threads of the screw to rotate and engage with the complementary threads of the receiving aperture of the barrel nut. Such engagement, and resulting friction, can cause the first member to slide away from the second member along the angled edges. The tongue and groove joint of the first member and second member keep the two members connected. The screw that is disposed in the channel, through the first and second member, can pivot as the members slide apart from each other, by operation of the tapered edges of the channel. As the planar body 130 expands and contracts, the barrel nut can revolve in place, further allowing the shaft of the screw 300 to pivot. In such a manner the planar body can expand and contract and a belt of sand paper 400 can be frictionally secured to the sanding block via the expansion of the planar body 130 against the inner circumference of the sanding belt.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sanding block, comprising: a first member and a second member forming a planar body; the first member has an angled edge; the second member has an opposing angled edge; the first member has a tongue disposed along the angled edge; the second member comprises a groove along the opposing angled edge, configured to receive the tongue; a continuous channel disposed through the first and second members of the planar body; a barrel nut disposed in the channel of the first member of the planar body; wherein the barrel nut is configured to revolve along an axis defined by a plurality of receiving apertures disposed in the barrel nut, wherein the plurality of receiving apertures are configured to receive a shaft of a screw therethrough; the screw disposed in the channel; wherein a head of the screw is rotatably disposed through an exterior edge of the second member; wherein the shaft of the screw passes through the channel and is threaded through the plurality of receiving apertures disposed in the barrel nut; wherein rotation of the screw expands and contracts the planar body.

2. The sanding block of claim 1, wherein an exterior edge of the first member opposite the angled edge is rounded.

3. The sanding block of claim 1, wherein an exterior edge of the second member opposite the opposing angled edge is rounded.

4. The sanding block of claim 1, wherein the planar body has a substantially rectangular cross section.

5. The sanding block of claim 1, wherein rotation of the screw expands and contracts the planar body along the angled edge and the opposing angled edge.

6. The sanding block of claim 1, wherein the channel is oriented along a width of the planar body.

7. The sanding block of claim 1, wherein the channel of the first member is wider than a diameter of the screw.

8. The sanding block of claim 7, wherein the channel of the first member tapers from the exterior edge to the barrel nut; wherein the channel is wider at the exterior edge than at the barrel nut.

9. The sanding block of claim 8, wherein the channel of the first member tapers from the angled edge to the barrel nut; wherein the channel is wider at the angled edge than at the barrel nut.

10. The sanding block of claim 1, wherein the channel of the second member is wider than a diameter of the screw.

11. The sanding block of claim 10, wherein the channel of the second member tapers from an exterior edge to the opposing angled edge; wherein the channel is wider at the opposing angled edge than at the exterior edge.

12. The sanding block of claim 1, wherein the head of the screw rests flush with the exterior edge, within a recess.

13. The sanding block of claim 1, wherein the angled edge of the first member is thirty degrees and the opposing angled edge of the second member is one hundred fifty degrees.

* * * * *